US011631578B2

(12) United States Patent
Kaushal et al.

(10) Patent No.: US 11,631,578 B2
(45) **Date of Patent: *Apr. 18, 2023**

(54) MULTIPLE GAS FLOW IONIZER

(71) Applicant: PERKINELMER HEALTH SCIENCES CANADA, INC., Woodbridge (CA)

(72) Inventors: Frenny Kaushal, Woodbridge (CA); Gholamreza Javahery, Woodbridge (CA); Lisa Cousins, Woodbridge (CA); Charles Jolliffe, Woodbridge (CA)

(73) Assignee: PerkinElmer U.S. LLC, Shelton, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/403,033

(22) Filed: Aug. 16, 2021

(65) Prior Publication Data

US 2022/0223399 A1 Jul. 14, 2022

Related U.S. Application Data

(63) Continuation of application No. 16/877,353, filed on May 18, 2020, now Pat. No. 11,094,520, which is a continuation of application No. 15/970,517, filed on May 3, 2018, now Pat. No. 10,658,168.

(51) Int. Cl.

| | |
|---|---|
| ***H01J 49/16*** | (2006.01) |
| ***H01J 49/42*** | (2006.01) |
| ***H01J 49/06*** | (2006.01) |

(52) U.S. Cl.
CPC ..... *H01J 49/161* (2013.01); *H01J 49/062* (2013.01); *H01J 49/167* (2013.01); *H01J 49/168* (2013.01); *H01J 49/42* (2013.01)

(58) Field of Classification Search
CPC ..... H01J 49/161; H01J 49/062; H01J 49/167; H01J 49/168; H01J 49/42
USPC ..... 250/423 R, 424, 288
See application file for complete search history.

(56) References Cited

U.S. PATENT DOCUMENTS

| | | | | |
|---|---|---|---|---|
| 10,658,168 | B2 * | 5/2020 | Kaushal | H01J 49/42 |
| 11,094,520 | B2 * | 8/2021 | Kaushal | H01J 49/167 |

* cited by examiner

*Primary Examiner* — Nicole M Ippolito
(74) *Attorney, Agent, or Firm* — Rhodes IP PLC; Christopher R Rhodes

(57) ABSTRACT

An ionizer includes a probe having multiple coaxially aligned conduits. The conduits may carry liquids, and nebulizing and heating gases at various flow rates and temperatures, for generation of ions from a liquid source. An outermost conduit defines an entrainment region that transports and entrains ions in a gas for a defined distance along the length of the conduits. In embodiments, various voltages may be applied to the multiple conduits to aid in ionization and to guide ions. Depending on the voltages applied to the multiple conduits and electrodes, the ionizer can act as an electrospray, APCI, or APPI source. Further, the ionizer may include a source of photons or a source of corona ionization. Formed ions may be provided to a downstream mass analyser.

15 Claims, 3 Drawing Sheets

MULTIPLE GAS FLOW IONIZER

TECHNICAL FIELD

This relates to mass analysis, and more particularly to ionizers for providing ions for mass analysis, and a method providing such ions.

BACKGROUND

Modern-day mass analysis/spectrometry relies on a supply of ionized analyte to a downstream mass analyser. Ionized analyte may be supplied by an ionizer that transforms non-ionized analyte—often in solvent—into gas phase ions.

Downstream, ions may be separated based on their mass to charge ratio, typically by accelerating them and subjecting them to an electric or magnetic field. This allows for the detection and analysis of a variety of chemical samples. Mass-spectrometry has found a wide variety of applications—and may be used in the detection of unknown compounds, or the identification of known compounds.

Known ionization techniques include electron impact (EI); atmospheric pressure chemical ionization (APCI); electrospray ionization (ESI); atmospheric pressure photoionization (APPI); and matrix assisted laser desorption ionization (MALDI).

Existing ionizers typically use a single one of these techniques, and each of these techniques suffers some imitations, such as sensitivity, depending on the analyte to be analysed.

Accordingly, there remains a need for new ionization techniques, and ionizers.

SUMMARY

According to an aspect, there is provided an ionizer that relies on gas flows to aid in the ionization of solvated analyte. Such gas flow ionization may be used in conjunction with APCI or APPI. A single ion source is operable in multiple modes, to allow switching between modes—and thus among multiple ionization techniques, for efficient and stable analyte ion production suitable for production of ions using electrospray, APCI and APPI ionization. The mode of operation may be chosen in dependence on the analyte. This provides increased sensitivity, reduced cost and improved ease of use, for both method development and routine analyses.

According to another aspect, there is provided an ionizer comprising: an outer gas transport tube having an outlet in flow communication with an inlet to a mass analyser; an inner gas transport tube extending into said outer gas transport tube; an innermost analyte supply tube extending into said inner gas transport tube, and upstream of said outlet, feeding droplets of solvated analyte from a tip of said analyte supply tube into said inner gas transport tube; a first supply gas within the inner gas transport tube, to aid in nebulizing said solvated analyte and shearing ions therefrom; a second supply gas within the outer gas transport tube to transport ions to said inlet of said mass analyser; at least one voltage source interconnected with said outer gas transport tube, said inner gas transport tube, and said analyte supply tube, said at least one voltage source operable to maintain said outer gas transport tube, said inner gas transport tube and said analyte supply tube at about equal potential offset from a potential of said inlet, to guide ions from said ionizer to said inlet.

According to another aspect, there is provided a method of producing analyte ions, comprising: providing droplets of solvated analyte from an analyte supply tube into an inner gas transport tube; providing a flow of a first gas coaxial to said analyte supply tube in said inner gas tube, to shear said droplets; providing said first gas flow, into a flow of second gas; guiding ions in said second gas by way of an electric field to a downstream mass analyser.

According to another aspect, there is provided an ionizer comprising: an outer gas transport tube formed of an insulating material, and having an outlet in flow communication with an inlet to a mass analyser; an inner gas transport tube formed of a conducting material extending into said outer tube; an innermost analyte supply tube extending from external to said outer gas transport tube into said inner gas transport tube, and upstream of said outlet, feeding droplets of solvated analyte from a tip of said analyte supply tube into said inner gas transport tube; a conductive sheath, proximate an outlet of said outer gas transport tube; a first supply gas within the inner gas transport tube, to aid in nebulizing said droplets of solvated analyte and shearing ions therefrom; a second supply gas within the outer gas transport tube to transport ions to said inlet of said mass analyser; and at least one voltage source interconnected with said conductive sheath and said innermost analyte supply tube, and said inlet to said mass analyser, said at least one voltage source operable to maintain said inner gas transport tube, said outer gas transport tube at a potential to ionize said solvated ions and guide ions from said outlet to said inlet of said ionizer.

Other features will become apparent from the drawings in conjunction with the following description.

BRIEF DESCRIPTION OF THE DRAWINGS

In the figures which illustrate example embodiments.

DETAILED DESCRIPTION

In embodiments, an ionizer includes a probe having multiple coaxially aligned conduits. The conduits may carry liquids, and nebulizing and heating gases at various flow rates and temperatures, for generation of ions from a liquid source. An outermost conduit defines an entrainment region that transports and entrains ions in a gas for a defined distance along the length of the conduits. In embodiments, various voltages may be applied to the multiple conduits to aid in ionization and to guide ions. Depending on the voltages applied to the multiple conduits and electrodes, the ionizer can act as an electrospray, APPI (atmospheric pressure photoionization), or APCI (atmospheric pressure chemical ionization) source, and the ionizer may include a source of photons or a source of corona ionization. Formed ions may be provided to a downstream mass analyser.

Figure 1:
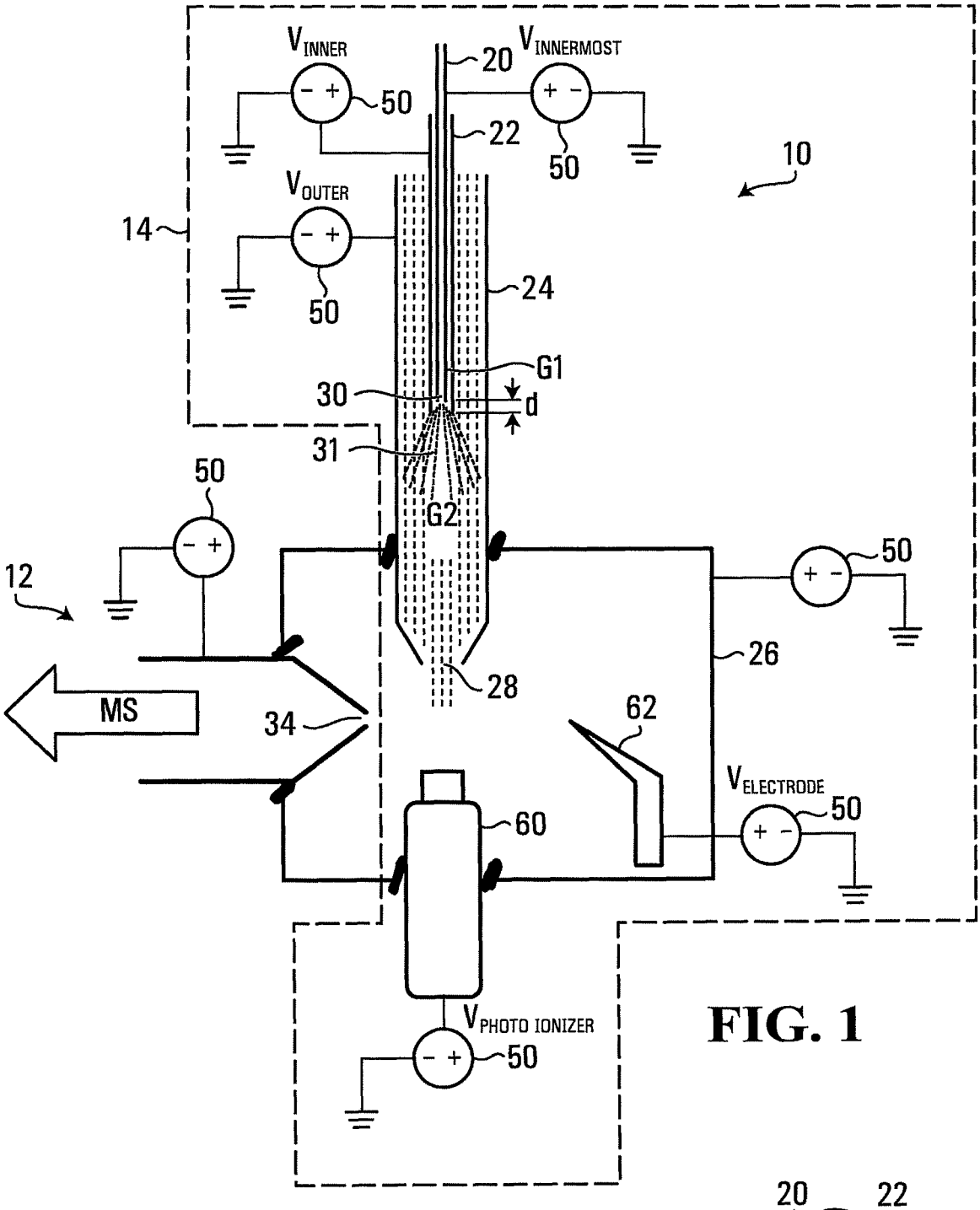
FIG. 1 is a simplified schematic block diagram of an exemplary ion source in communication with components of a downstream mass analyser.

FIG. 1 illustrates an example ionizer 14, including probe 10 suited to provide ionized analyte to a downstream mass analyser 12. Ionizer 14 may form part of the mass analyser 12, or be separate therefrom. Mass analyser 12 may take the form of a conventional mass analyser, and may, for example, be a quadrupole mass spectrometer as disclosed in U.S. Pat. Nos. 7,569,811 and 9,343,280, the contents of which are hereby incorporated by reference. Inlet 34 to mass analyser 12 is illustrated.

As illustrated in FIG. 1, a probe 10 is part of an ionizer 14. Probe 10 includes three nested tubes 20, 22, and 24 that create, from a source (not specifically illustrated) of solvated analyte, ionized analyte entrained in a transport gas G2. Nested tubes 20, 22 and 24 may be co-axial to each other, and generally cylindrical in shape. Each of tubes 20, 22 and 24 may be formed of a conductive or insulating material. In the embodiment of FIG. 1, tubes 20, 22, 24 may be conductive—formed of a metal or metal alloy—such as aluminium, stainless steel, or the like. Other geometries and materials will become apparent to those of ordinary skill.

Ionizer 14 further includes housing 26, interconnecting probe 10 to a downstream mass analyser 12. Optional electrode 62 and optional photo-ionizer 60 may be contained within housing 26, and are detailed below.

In the depicted embodiment of FIG. 1, each of tubes 20, 22 and 24 may be formed of conductive material. Innermost analyte supply tube 20 provides from its tip 30, solvated analyte in droplets into an inner gas transport tube 22 that carries a first supply gas G1. Tip 30 may be positioned flush with the exit of tube 22. In alternative embodiments, tip 30 could be several millimetres interior, or exterior to the exit of tube 22. Tube 24, however, extends a defined distance d beyond tip 30. Solvated analyte may flow from a source (not shown) of solvated analyte exterior to ionizer 14 to the tip 30 of analyte supply tube 20. Typically the source of analyte may provide solvated analyte in desired concentrations over multiple orders of magnitude.

The outlet of tube 22 is positioned a distance d of about one to three centimetres from outlet 28 of outer gas tube 24, although this position may be varied over a range, between one and ten centimetres upstream of outlet 28 to allow transport gas in outer tube 24 to entrain ions, providing enhanced sensitivity and stability of the generated source of ions.

One or more voltage source(s) 50 may apply relative potentials to tubes 20, 22, 24 to allow ionizer 14 to function in one of multiple modes. For purposes of explanation, source 50 applies potential $V_{innermost}$ to tube 20; $V_{inner}$ to tube 22; and $V_{outer}$ to tube 24. As will become apparent, the relationship of $V_{innermost}$; to $V_{inner}$ and $V_{outer}$ will control the mode of operation of probe 10. In embodiments, applied voltages may to tubes 20, 22, 24 may be the same or they may be different, determining how or if electric fields are formed.

Probe 10 may also be mechanically configured such that inner coaxial tube 22, sample innermost tube 20 or probe 10 may be independently adjusted relative to inlet 34 of downstream mass analyser 12 in order to be adjustable along axes x,y and z, Further, an inner coaxial tube 22 and sample innermost tube 20 may be positionable along the z axis, relative to outer tube 24. In this way, the distance d between tip 30 of tube 20, and the end/outlet of outer tube 24 may be adjusted for adjust/optimize sensitivity and signal stability.

For example concentrations of analyte in solution in ranges from below 1 femtogram per μL solvent to above 1 microgram per μL solvent may be introduced through inner coaxial tube 22. Solvents may be a water and acetonitrile mix (for example 50:50 or 30:70) to promote ion formation and liberation. Solvent may be further adjusted with 0.1% formic acid and 2 mM ammonium acetate, although the exact amount may be varied.

Inner gas transport tube 22 carries a first gas G1, at a velocity v1, that aids in nebulizing analyte molecular ions released in droplets at a tip 30 of innermost (supply) tube 20, producing a spray 31. Outer (gas transport) tube 24 transports a second gas G2 of velocity v2 that interacts with solvated analyte at tip 30 and with spray 31 to produce analyte ions from solution. As will be apparent the use of two gas flows facilitates analyte ion release and transport. Gas G2 may be heated above ambient to further aid in release of ions by use of heaters upstream of the gas flow.

Gas G1 may, for example, be Zero Air/Clean air Nitrogen provided from a pressurized source—such as a vessel (not shown), or the like.

Gas G2 may for example be air/clean air; Nitrogen, or the like.

Gas G1 and G2 may be maintained at a temperature between about 30 and 700° C., but lower temperatures may be possible. Typical temperature rages are between 250° C. and 700° C., but higher temperatures may be possible.

Gas G1 exiting inner gas transport tube 22 enters outer gas transport tube 24, which transport analyte ions entrained in a gas G2 to exit 28 of tube 24.

G2 mixes with first gas G1 in outer gas transport tube 24 and transports entrained ionized analyte from gas transport tube 24, into ionizer housing 26.

Inner gas G1 produces spray 31 at exit 30. Spray 31 extends radially outward and mixes with outer gas G2, bounded by the wall of outer gas transport tube 24, typically within several cm (e.g. between about 1 and 10 cm) downstream from exit 30 and becomes entrained in outer gas G2, and analyte ions are transported in the combined flow distance d to exit 28.

Housing 26 houses at least the tip of probe 10 and provides an enclosure to maintain a suitable environment for transport and guiding of ionized analyte to downstream stages of a mass analyser 12. In the depicted embodiment, ions are guided by way of an electric field, between exit 28 of tube 24, and inlet 34 of downstream elements of mass analyser 12. Additional electrodes (not shown) with housing 26 may be used to further aid in guiding ions to inlet 34. Housing 26 may be formed of a conductive material. The interior of housing 26 may be maintained at about atmospheric pressure, although higher pressures (e.g. between up to 100 T to 2000 T) and lower pressures are possible. Housing 26 may be evacuated by an evacuation pump (not shown).

Figure 2:
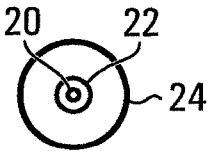
FIG. 2 is a cross-sectional schematic view of analyte supply, and gas transport tubes of FIG. 1.

In the depicted embodiment, analyte tube 20 and inner gas transport tube 22 may be coaxial, as best illustrated in cross-section in FIG. 2.

Tip 30 of analyte supply tube 20 has an opening that releases solvated analyte in droplets. For example, tip 30 may take the form of a needle opening with inner diameter of between 50 and 250 microns. Tip 30 may be spaced from the outlet of inner gas transport tube 22, plus or minus by several millimetres, thereby releasing droplets urged by gas flow from inner gas transport tube 22.

Inner gas transport tube 22 has inner diameter that is several times (e.g. between 2 and 20 times), as large as the inner diameter of the opening of tip 30. Outer gas transport tube 24 may have an inner diameter that is several times (e.g. 2 to 5 times) as large as the inner diameter of inner gas transport tube 22. First gas G1 flows from outside of probe 10, along the length of transport tube 22, in a direction co-axial to analyte supply tube 20. As such, the gas is generally tangent to analyte droplets being released from analyte supply tube 20 into outer gas transport tube 22, at tip 30 of analyte supply tube 20.

In the depicted embodiment, the flow rates of first gas G1 in the vicinity of tip 30, in transport tube 22 may typically be between 1 and 5 standard litres per minute (SLPM) and the flow rate of gas G2 in transport tube 24 may be between 5 and 100 SLPM.

Gases G1 and G2 may be introduced at pressures in the range from 101 kPa to 1000 kPa, and typically between 300 kPa and 700 kPa.

Velocities v1 and v2 are influenced by upstream pressures of G1 and G2 and by tube diameters. Exit velocity v1 may be subsonic or sonic. Velocity v2 is typically much less than v1.

Inlet 34 may further be configured to provide counterflow gas to aid in reducing the transmission of large droplets downstream, by addition of a counterflow gas exiting inlet 34 or exiting a second cone positioned upstream and proximate inlet 34 (not shown) in the direction of housing 26.

Without wishing to be bound by any particular theory, it is believed that the interaction of the flow of gas G1 in gas transport tube 22, and gas G2 in transport tube 24 applies shearing forces to solvated analyte molecules at tip 30, thereby stripping analyte from solvent (e.g. water, methanol or the like) molecules, and further liberating analyte ions. Notably, in the depicted embodiment, this may be accomplished in the absence of any significant electric field at tip 30.

Gas G2 may further interact with the analyte and gas G1. The interaction may be physical or chemical, whereby ions formed are then entrained in gas G2 as they exit probe 10 at exit 28.

As noted, voltages $V_{innermost}$ to tube 20; $V_{inner}$ to tube 22; and $V_{outer}$ to tube 24 of probe 10, may be selected to provide an electric field to guide ions from exit 28 of tube 24 through housing 26 into inlet 34. Likewise, a suitable voltage may be applied to electrode 62 to further aid in guiding the ions to inlet 34.

In the depicted embodiment, probe 10 is configured such that tubes 20, 22 and 24 are conductive. In a first mode of operation, voltage source 50 may be configured to maintain the electric potential of outer gas transport tube 24, inner gas transport in tube 22 and analyte supply tube 20 about equal. Each tube 20, 22, and 24 may each thus be maintained at a uniform potential. So configured, the potential at tip 30 of inner gas transport tube 22 is unlike that applied in conventional electrospray ionization, as no significant voltage/field is applied to droplets exiting tip 30.

The voltage applied to tubes 20, 22 and 24 may be non-zero to further create a guiding electric field from exit 28 to inlet 34, to maximize transmission of ions to mass analyser 12.

The polarity of the voltage can be selected depending on the charge of the analyte to be analysed. For example, typically, for positively charged analytes, voltage source 50 may maintain tubes 20, 22, and 24 at a potential between 0 and 5000V, and between 0 and −5000V for negatively charged analytes.

Optionally a voltage, $V_{electrode}$, may be applied to electrode 62 to further aid in guiding analyte ions from exit 28 to inlet 34. Electrode 62 may be a lens of any shape including a blunt or sharp tip needle, with voltages of about 10-5000V, chosen relative to the voltage applied to tubes 20, 22 and 24 to aid in guiding ions into inlet 34. Optionally an additional voltage, $V_{inlet}$, (not shown) may be applied to electrode at inlet 34 to further aid in guiding ions, of about 10-2000V. To that end, the portion of mass analyser 12 proximate inlet 34 may be formed of a conductive material that defines inlet 34. Alternatively, an electrode (not shown) may be located just downstream of inlet 34, to allow the potential to be applied.

Gas G1 exiting inner gas transport tube 22 carrying ions, as well as some solvated analyte, mixes with second gas G2 in outer transport tube 24, and may be entrained therein. The flow of second gas G2 in and toward the outlet of outer tube 24 may similarly be maintained by a suitable pressure and flow regime.

As noted in the depicted embodiment, the flow rates of second gas G2 in the vicinity of the exit of outer gas transport tube 24 is between approximately 5 and 100 SLPM. In order to achieve this, the diameter of outer transport tube 24 may be about 3 mm, and the inlet pressure of gas G2 may be several atmospheres, controllable by a variable orifice (not shown), as is known in the art. As depicted in FIG. 1, outer transport tube 24, may further taper in diameter proximate its exit 28. In this way, transport gas exiting transport tube 24 may exit at a slightly increased velocity.

Once transport gas G2 containing ionized analyte exits transport tube 24, analyte ions may be guided to the entrance of downstream components of a mass analyser 12, by a suitable electrical field gradient between the exit 28 of tube 24, and inlet 34 to downstream portions of mass analyser 12. Inlet 34 may again be conductive—formed as a metal electrode—from a material such as stainless steel. The electric field gradient may, for example, be established within housing 26 by applying a suitable voltage difference between exit 28 of tube 24, and inlet 34 of downstream components of mass analyser 12.

In the depicted embodiment, voltage source 50 may apply a potential between the exit 28 of tube 24 and the inlet 34 of downstream portions of mass analyser 12. As noted, a portion of mass analyser 12 near inlet 34 may, for example, also be conductive to allow this potential to be maintained.

Housing 26 may also be maintained at or about the potential of outer gas transport tube 24 (and thus tubes 20 and 22), by voltage source 50 or may simply be electrically conducted to transport tube 24.

An optional photo-ionizer 60 may be placed within housing 26. In the first mode of operation described above, photo-ionizer 60 may be inactive and voltage source 50 may apply a potential, $V_{electrode}$, to electrode 62 to aid in the guidance of ions from outlet 28 to inlet 34. Alternatively, electrode 62 may also be inactive. In an embodiment, voltage source 50 may alternatively apply zero potential to tubes 20, 22, and 24.

In a second mode of operation, a high voltage, $V_{electrode}$, may also be applied, for example by voltage source 50, to electrode 62 to a sharp-tipped electrode, to effect corona discharge. Gases G1 and G2 and solvated analyte may flow as described in the first mode of operation. For example, an appropriate voltage between 1000V and 6 kV may be applied to electrode 62 proximate its tip, at a current, for example between 1 and 500 uA, creating a corona discharge. Analyte entrained in gas G2 may thus further be ionized by corona discharge at electrode 62.

In this second mode of operation, analyte entrained in gas G2 may be less efficiently ionized, depending on analyte polarity, polarizability, solvent matrix, solvent composition, pH, and the like, and ionization may instead be effected at electrode 62. The voltage, $V_{electrode}$, applied to electrode 62 may now be current controlled to encourage formation of corona ions. In this configuration, ionizer 14 vaporizes the liquid in the sample inlet tube and formation of corona ions near electrode 62 acts as an atmospheric pressure chemical ionization (APCI) source.

In a further third mode of operation photo-ionizer 60 may be energized, and the voltage applied to tubes 20, 22 and 24 by voltage source 50 may be slightly lower than described above, although kept at equal relative levels. For example, 500 Volts (relative to ground) may be applied to each of tubes 20, 22 and 24. Photo-ionizer 60 may photo-ionize analyte entrained in gas G2. As may be apparent, to be most effective, analyte or an added reagent gas species should be susceptible to photo-ionization.

In this mode probe 10, in combination with photo-ionizer 60, acts as an atmospheric pressure photoionization source. The voltage applied to inlet 34 of downstream portions of mass analyser 12 may be adjusted accordingly—for example below 500 Volts—in order to maintain a guiding electric field gradient between exit 28 of outer gas transport tube 24 and inlet 34.

In a fourth mode of operation, power supply 50 may apply a sufficient potential difference to tubes 20 and 24 to create an electric field that effects electrospray ionization at tip 30 of tube 20. For example, a potential difference Vinnermost-Vouter of between 1000 and 6000 Volts may be applied to establish an electric field for positive ion formation, (Similarly −1000 to −6000 Volts may be applied for negative ion formation). The potential applied to outer tube 24 may further aid guiding ions. In an embodiment, the potential applied to inner tube 22 equals that of innermost tube 20 ($V_{innermost}-V_{inner}=0$). For example, to produce positive electrospray ions, a voltage between 1000 and 6000 may be applied to innermost tube 30, and a voltage between 0 and 1000 may be applied to outer tube 24, such that an electrospray electric field is established between tube 30 and tube 24. Electrospray ions thus produced may be entrained in gas G2 and further guided into inlet 34. Other voltage combinations are possible. Electrode 62 may further be biased to further guide ionized analyte to inlet 34. Suitable voltages may also be applied by supply 50 to inlet 34 and to electrode 62 (and any other optional guide electrode—not shown) to aid in directing ions into mass analyser 12.

In practice, different modes may provide better ionization for different suites of molecules, including improved sensitivity, detection limits, and reproducibility.

For example, the first mode may efficiently generate highly polar molecular ions with high sensitivity. The second and third mode may efficiently generate less polar molecules that respond well to APCI and APPI, and so on. The fourth mode may efficiently generate less polar molecular ions that respond well to conventional electrospray.

To this end, voltages applied by source 50 (e.g. $V_{outer}$; $V_{inner}$; $V_{innermost}$; and $V_{electrode}$; and on/off control/voltage of photo-ionizer 60) may be applied sequentially in time, for example, to correlate with elution times from a column of a liquid chromatographic analysis. Unique methods may be established for the compounds of interest and optimized voltages may be applied, enhancing throughput.

Alternatively it is also possible to utilize only one or two ionization modes within a chromatographic run. It may be beneficial to then rapidly move to a second chromatographic run, without the need to physically switch ion sources.

Mass analyser data may be accompanied with an electronic identification and time stamp corresponding to the active ionization mode. In this way data from each mode can be correlated to the appropriate concentration curve for analyte quantitation, enabling rapid data analysis for each mode.

Figure 3:
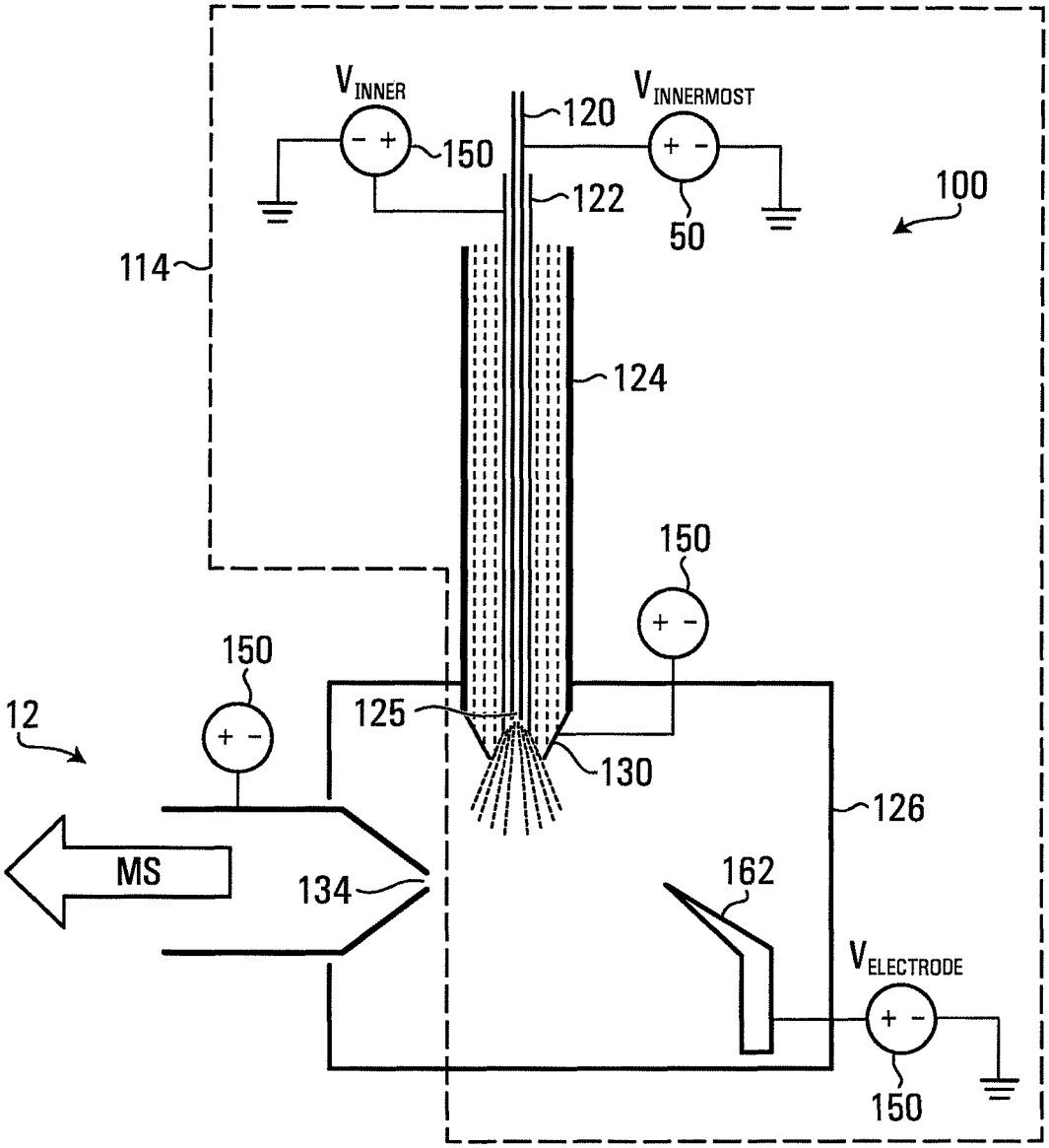
FIG. 3 is a simplified schematic block diagram of a further exemplary ion source in communication with components of a downstream mass analyser.

An alternate probe 100 is depicted in FIG. 3. Probe 100 is structurally similar to probe 10 (FIGS. 1-2), and forms part of ionizer 114. Probe 100 includes three concentric tubes 120, 122 and 124, similar to tubes 20, 22 and 24 of probe 10. Analyte supply tube 120 is surrounded by first gas supply tube 122, which is surrounded by second gas supply tube 124. Gas G2 may again be heated to further aid in desolvation and release of ions from electrospray.

Gas supply tube 124, however, unlike tube 24 of probe 10, is formed of an insulating material. A conductive end portion 130 may be formed as a metal annular ring, sleeve or sheath attached and extending from tube 124. End portion 130 may be tapered and is positioned so that its top may be aligned with tip 125. The length of tip 130' may be varied 1-10 mm from tip 125 to permit mixing, entrainment, laminarization and/or efficient ion transfer of ions formed.

A voltage source 150 may apply potentials to tubes 120, 122 and end portion 130. A potential may be applied between sample inlet tube 120 and conductive end portion 130 such that electrospray ionization is formed.

Voltage on tube 120 can be between 0-5000V and voltage on end portion 130 can be between 0-5000V, provided by one of more voltage sources 150. For example, to release positive ions, voltage on tube 120 may be several thousand volts more positive than voltage on end portion 130 for positive ions, and several thousand volts more negative to produce negative ions. The electric field between tip 125 and inlet 134 of downstream stages of mass analyser, and optional electrode 162 is configured to guide ions from end portion 130 to inlet 134, in the same way as electrode 62 is configured.

In alternate embodiments, end portion 130 can be otherwise insulated from tube 124. In this way tube 124 can be formed of any material. End portion 130 may be insulated from tube 124, by physically separating it from end portion 130, or by interposing an spaced (e.g. an annular spacer forme of insulating material) between end portion 130 and tube 124.

Probes 10 and 100 can also be operated with tube 20/120 configured for one polarity of ions but the electric field which guides ions into inlet 34/134 of downstream stages of mass analyser is configured for opposite polarity. For example, for probe 100, −3000V may be applied to tube 120 and +2000V is applied to end portion 130. This allows positive ions produced from a negative electrospray to be guided to inlet 134, maintained at +500V. Similarly, by switching polarity of applied voltages, it is possible to guide negative ions from positive electrospray to inlet 134 at −500V. It will be appreciated that these voltages are simply example ranges.

Second gas supply tube 124, however, unlike tube 24 is formed of an insulating material with a conductive end 130. The end 130 need not be tapered.

Figure 4:
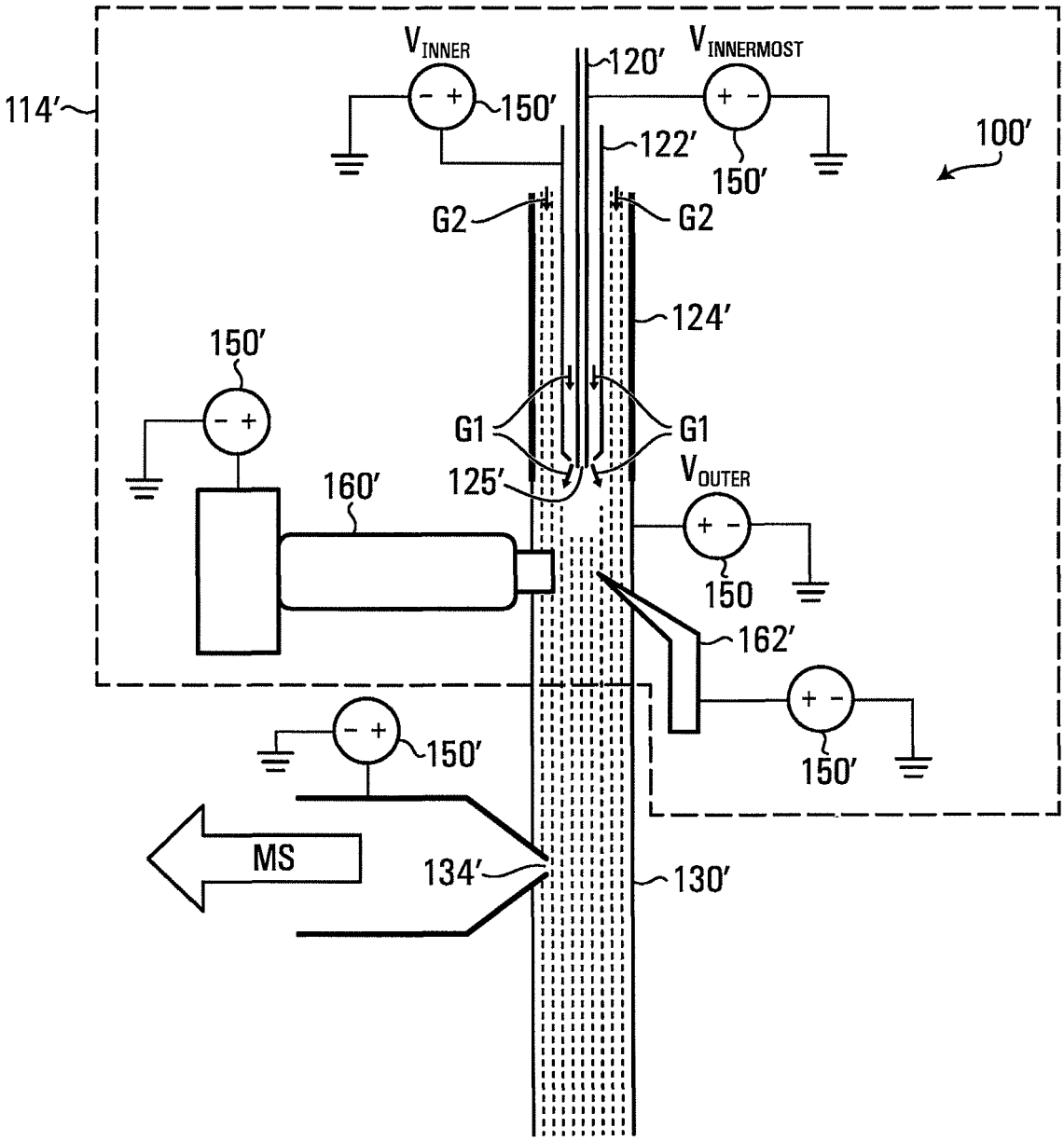
FIG. 4 is a simplified schematic block diagram of a further exemplary ion source.

FIG. 4 illustrates yet a further probe 100', forming part of ionizer 114'. Probe 100' includes functional components similar to those of probe 10 of ionizer 14, but more compactly arranged. To that end, tubes 120', 122' and 124', one or more voltage source(s) 150' and gas flows G1 and G2 are generally to the same as their counterparts in probe 100 (FIG. 3), with electrospray electric field formed between tip 125' and end 130'. However, conductive end 130' is longer than tip 30 to permit the entrainment and guidance of ions formed from an electrospray process, guiding to inlet 134' insulated from end 130' by insulators (not specifically shown), thus improving sensitivity and eliminating the need for a housing (like housing 26).

In the depicted embodiment of FIG. 4, voltage may be applied to tube 120' of 5000V, tube 130' of 1000V, inlet 134' of 0-500V to generate ESI ions. Opposite polarity may be used for negative ions. Furthermore, electrode 162' (like electrode 62) and photo-ionizer 160' (like photo-ionizer 60) are located within outer gas transport tube 24' (like outer gas transport tube 24 of FIG. 1) and may be selectively activated as described with reference to FIG. 1.

Similar elongated tube 24 of ionizer 14 may be applied to ionizer 14 as well, whereby tube 24 may be elongated to help guide ions through 34, utilizing insulators to permit separate voltages on inlet 34 and tube 24.

Of course, the above described embodiments are intended to be illustrative only and in no way limiting. The described embodiments are susceptible to many modifications of form, arrangement of parts, details and order of operation. The invention is intended to encompass all such modification within its scope, as defined by the claims.

What is claimed is:

1. An ionizer comprising:

an outer gas transport tube having an outlet in flow communication with an inlet to a mass analyser;

an inner gas transport tube extending into said outer gas transport tube;

an innermost analyte supply tube extending into said inner gas transport tube, and upstream of said outlet feeding droplets of solvated analyte from a tip of said analyte supply tube into said inner gas transport tube; and a first supply gas within the inner gas transport tube, to aid in nebulizing said solvated analyte and shearing ions therefrom; a second supply gas within the outer gas transport tube to transport ions to said inlet of said mass analyser: and at least one voltage source interconnected with said outer gas transport tube, said inner gas transport tube, and said analyte supply tube, said at least one voltage source operable to maintain said outer gas transport tube, said inner gas transport tube and said analyte supply tube at about equal potential offset from a potential of said inlet, to guide ions from said ionizer to said inlet of said mass analyzer.

2. The ionizer of claim 1, wherein each of said outer gas transport tube, said inner gas transport tube and said analyte supply tube is conductive.

3. The ionizer of claim 1, further comprising an electrode external to said outer conductive tube, between said outlet and said inlet to said mass analyser, and wherein said at least one voltage source further applies a potential to said electrode.

4. The ionizer of claim 3, wherein said at least one voltage, source, in a second mode, applies potential to said outer gas transport tube, said inner gas transport tube, said analyte supply tube, and said electrode to produce corona discharge and allow atmospheric pressure chemical ionization.

5. The ionizer of claim 1 further comprising a photo-ionizer, between said outlet and said inlet of said mass analyser.

6. The ionizer of claim 1, wherein said analyte supply tube has an inner diameter of between 50 and 250 microns.

7. The ionizer of claim 1, wherein said inner gas transport tube guides a flow of said first gas at between 1 and 5 SLPM.

8. The ionizer of claim 1, wherein said first gas has a temperature between about 30° C. and 700° C.

9. The ionizer of claim 1, wherein said outer gas transport tube guides a flow of said second gas at between 5 and 100 SLPM.

10. The ionizer of claim 1, wherein said second gas has a temperature between about 30° C. and 700° C.

11. The ionizer of claim 2, wherein said at least one voltage source maintains said inner gas transport tube, said outer gas transport tube and said analyte supply tube at a potential between OV and 6000V, relative to said inlet of said mass analyser.

12. The ionizer of claim 11, wherein said inlet to said mass analyser is maintained between OV and 500V, relative to ground.

13. The ionizer of claim 1, wherein said outer gas transport tube extends a defined distance beyond a tip of said innermost analyte supply tube.

14. The ionizer of claim 13, wherein said defined distance is between about 10 mm and about 1000 mm.

15. The ionizer of claim 14, wherein said defined distance is about 30 mm.

* * * * *